US010301136B2

(12) United States Patent
Jariabka et al.

(10) Patent No.: US 10,301,136 B2
(45) Date of Patent: May 28, 2019

(54) ROLLER LOCKS

(71) Applicant: Hewlett-Packard Development Company, L.P., Houston, TX (US)

(72) Inventors: Keith Jariabka, Portland, OR (US); Erik Roby, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,045

(22) PCT Filed: Jan. 8, 2016

(86) PCT No.: PCT/US2016/012654
§ 371 (c)(1),
(2) Date: Mar. 23, 2018

(87) PCT Pub. No.: WO2017/119899
PCT Pub. Date: Jul. 13, 2017

(65) Prior Publication Data

US 2018/0273331 A1 Sep. 27, 2018

(51) Int. Cl.

| | |
|---|---|
| ***B65H 27/00*** | (2006.01) |
| ***B41F 13/008*** | (2006.01) |
| ***B65H 29/20*** | (2006.01) |

(52) U.S. Cl.
CPC ..... *B65H 27/00* (2013.01); *B41F 13/008* (2013.01); *B65H 29/20* (2013.01); *B65H 2402/64* (2013.01); *B65H 2404/165* (2013.01); *B65H 2404/64* (2013.01)

(58) Field of Classification Search
CPC ..... B65H 27/00; B65H 29/20; B65H 5/06; B65H 5/14; B65H 3/00; B65H 3/06; B65H 2402/64; B65H 2404/165; B65H 2404/16; B41F 13/008; B41F 13/20; B41F 31/30; F16D 23/00; F16D 11/04
See application file for complete search history.

(56) References Cited

U.S. PATENT DOCUMENTS

| | | | |
|---|---|---|---|
| 5,240,239 | A | 8/1993 | Kim |
| 5,486,910 | A | 1/1996 | Harada |
| 6,530,706 | B2 | 3/2003 | Sugimoto et al. |
| 6,874,963 | B2 | 4/2005 | Yang et al. |
| 7,252,283 | B2 | 8/2007 | Lan et al. |
| 7,651,082 | B2 | 1/2010 | Hendrix et al. |
| 7,731,174 | B2 | 6/2010 | Lee et al. |

(Continued)

FOREIGN PATENT DOCUMENTS

| | | |
|---|---|---|
| CN | 102674035 | 9/2012 |
| EP | 0921082 | 6/1999 |
| JP | 2004092887 | 3/2004 |

*Primary Examiner* — David H Bollinger
(74) *Attorney, Agent, or Firm* — HP Inc. Patent Department

(57) ABSTRACT

In an example, a roller lock may include a lock to engage with a roller of a feed system, and a leadscrew to engage with the lock. The lock may include a coupling to operably engage with a complementary coupling of the roller. The leadscrew may include an advancer to engage with the lock such that the advancer may translate the lock along a longitudinal axis of the roller so that the lock may engage and disengage with the roller to intermittently prevent the roller from rotating in a forward direction.

15 Claims, 4 Drawing Sheets

(56) References Cited

U.S. PATENT DOCUMENTS

| | | | | |
|---|---|---|---|---|
| 8,276,904 | B2 | 10/2012 | Ching-Tse | |
| 2010/0156029 | A1 | 6/2010 | Kwak et al. | |
| 2013/0241136 | A1 | 9/2013 | Hosohara | |
| 2014/0048378 | A1 | 2/2014 | Kim et al. | |
| 2017/0274640 | A1* | 9/2017 | Wientjes | B41F 5/24 |
| 2017/0368851 | A1* | 12/2017 | Kawashima | B65H 3/0638 |

* cited by examiner

ROLLER LOCKS

BACKGROUND

Print media systems may print, scan, copy, or perform other actions with print media. Further, print media systems may include feeding systems to pick up and load the print media, or, in other words, deliver or drive the print media through the print media system for performing operations on the media. Scanning systems may scan the media for markings or patterns. Printing systems may deposit printing fluid, such as ink, or another printing substance, such as three-dimensional printing powder, on the print media. Copying systems may produce duplicates of print media, including markings or patterns thereon. The scanning, printing, and copying systems may be integrated together, or disposed separately from each other.

DETAILED DESCRIPTION

Figure 1A:
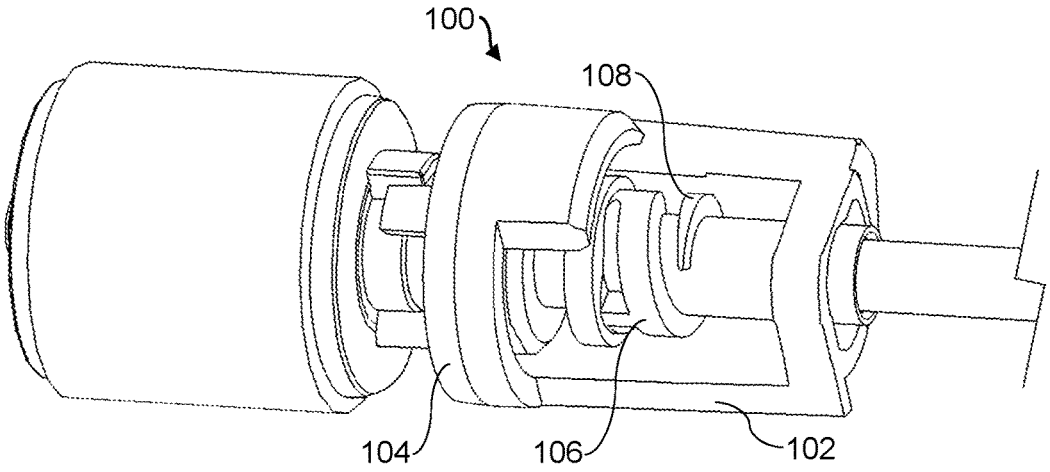
FIG. 1A is a perspective view of an example roller lock.

Print media systems may include scanning systems, copying systems, printing systems, or other systems that perform actions on or with print media. Scanning systems may optically or electrically scan print media. Scanning systems may also be used in conjunction with printing systems. Printing systems may deposit printing fluid, such as ink, or another printing substance, such as three-dimensional printing powder, on print media. The scanning system may be integrated with the printing system, or disposed separately from the printing system. Additionally, in some situations, the scanning system and/or printing system may be part of, engaged with, or used in conjunction with a copying system. In such a system, the scanning system may scan print media, followed by the copying system producing a duplicate of the print media based on the scan conducted by the scanning system. The copying system may produce the duplicate by utilizing the printing system to deposit print substance on a print media in the same manner or patterns as on the scanned print media.

The scanning system, copying system, printing system, or other print media system may include a pick system, which, in some situations, may also or alternatively be referred to as a feed system or a load system. The pick system may pick up and load print media, or, in other words, pick and deliver or drive the print media through a media path of the corresponding print media system.

In some situations, a load stop or a stack stop may be employed by a print media system, or another system that may receive print media from a user or mechanism. Such a load stop may prevent the user from loading print media incorrectly, or, in other words, from inserting print media too far or not far enough into the respective receiving print media system. Print media that is loaded too far or not loaded far enough into the print media system may not be correctly picked and loaded by the pick system. The pick system may fail to pick any of the print media, or may pick more than one piece of print media at a time if the print media is loaded incorrectly into the print media system. The load stop may avoid incorrect loading by providing tactile feedback to the user or mechanism that is inserting the print media when the print media is sufficiently loaded, and before the print media is loaded too far into the system. Such a load stop may include an element or feature such as a wall, or protrusion that the print media may contact upon sufficient insertion, thus preventing the print media from being inserted any further into the system. Upon the print media being correctly or sufficiently loaded, the pick system may properly engage with the print media and load one piece of print media at a time through the media path of the print media system.

In some situations, the load stop may be a fixed element or feature within the print media system. The print media may then be inserted into the system until the media contacts the load stop. In such a situation, the pick system may be a movable system that is pivoted, rotated, translated, or otherwise moved out of the way of the insertion of the print media to allow for a clean insertion of the print media until the media contacts the load stop. The pick system may then be moved into an engagement position with the print media such that the pick system may properly pick a piece of the print media for loading. Such a system may be overly complex and have several moving linkages or mechanisms to ensure the proper insertion and picking of the print media. In a print media system with tight space or volumetric constraints, such an insertion and pick architecture may be impractical or impossible to employ.

In other situations, the pick system may be fixed within the print media system such that it is always engaged with the print media, and stays in the same location during insertion of the print media into the system. In such a situation, the load stop may be a movable mechanism or include a movable element or feature that is moved into place for insertion of the print media, so as to prevent incorrect loading of the print media, and then is moved out of the way so as to allow the pick system to properly engage with and pick a piece of print media for driving through the media path of the system. A system such as this may also be overly complex and impractical or impossible to implement in a print media system having tight space and volumetric constraints.

Implementations of the present disclosure provide roller locks to engage with pick systems of print media systems to provide load stops for print media during print media insertion. Example roller locks provide a load stop that is integrated into the respective pick system which may be employed in a compact fashion. The integration of the load stop into the pick system may allow the roller locks to be implemented in print media systems having tight space and volumetric constraints, and may include a less complex picking and load stop mechanism.

Figure 1B:
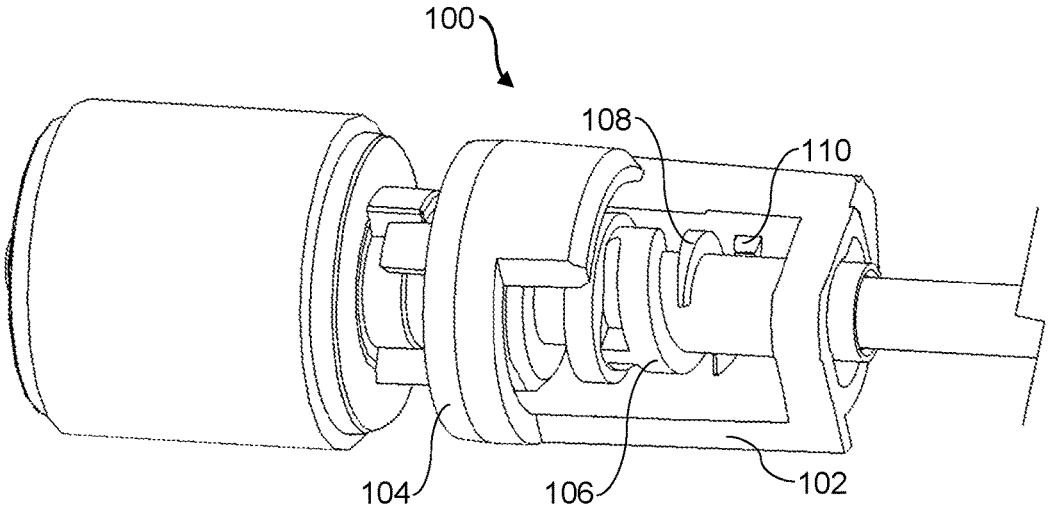
FIG. 1B is a perspective view of an example roller lock.

Referring now to FIG. 1A, a perspective view of an example roller lock 100 is illustrated. The example roller lock 100 may include a lock 102 to engage with a roller of a feed system. The lock 102 may include a coupling 104 to operably engage with a complementary coupling of the roller. Further, the roller lock may include a lead screw 106. In some implementations, the lead screw 106 may engage with the lock 102. Additionally, the lead screw 106 may include an advancer 108 to engage with the lock 102 such that the advancer 108 may translate the lock 102 along a longitudinal axis of the roller or feed system so that the lock 102 may engage and disengage with the roller to intermittently prevent the roller from rotating in a forward direction. Referring additionally to FIG. 1B, in some implementations, the advancer 108 may engage with a complementary advancing feature 110 of the lock to translate the lock 102 along the longitudinal axis.

Figure 2A:
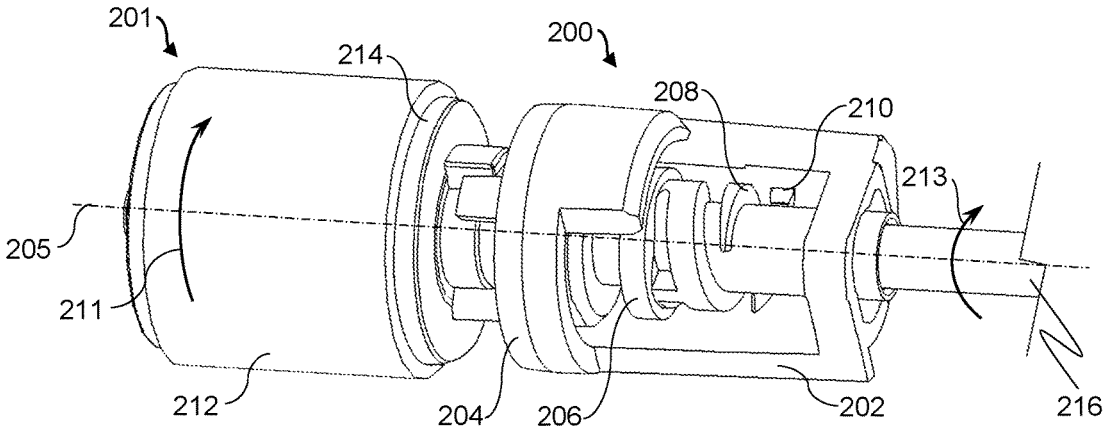
FIG. 2A is a perspective view of an example roller lock.

Referring now to FIG. 2A, a perspective view of an example roller lock 200 is illustrated. Example roller lock 200 may be similar to example roller lock 100. Further, the similarly named elements of example roller lock 200 may be similar in function and/or structure to the elements of example roller lock 100, as they are described above. Roller lock 200 may include a lock 202 and a lead screw 206. The lock 202 may engage with a roller 212 of a feed system 201 within a print media system. It is worth noting that, in some situations, the roller lock 200 may also be considered as being a part or component in the feed system 201. In some implementations, the roller 212 may be a round, cylindrical, or spherical component capable of advancing print media through a media path of a print media system. In further implementations, the roller 212 may include a tacky or rubberized coating, or be constructed out of rubber or a similar material having a coefficient of friction sufficient to grip print media.

Figure 2B:
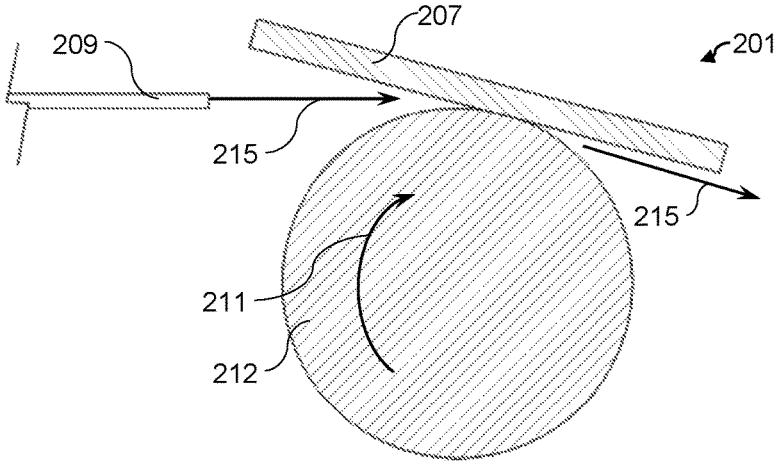
FIG. 2B is a schematic view of an example roller of a feed system with an example roller lock.

The feed system 201 may further include a drive shaft 216. In some implementations, the drive shaft 216 may be a rod or other cylindrical component disposed coaxially to the roller 212 along a longitudinal axis 205. In other implementations, the drive shaft 216 may be disposed eccentrically to the roller and utilize a transmission, gear or set of gears, or other mechanism or linkage to engage with the roller 212. In further implementations, the drive shaft 216 may rotate in a forward direction 213 and thereby drive the roller 212 such that the roller 212 rotates in a forward direction 211. In this context, the forward direction may refer to the direction in which the roller 212 may rotate in order to advance print media through the feed system 201. The forward direction 211 may be a rotational direction about longitudinal axis 205. In some implementations, the feed system may include a clutch operably disposed in between the drive shaft 216 and the roller 212 such that the drive shaft 216 drives the roller 212 through the clutch. Referring additionally to FIG. 2B, as a result of rotating in the forward direction 211, the roller 212 may advance print media 209 or a portion or piece of print media 209 in a direction 215 through the feed system 201, and/or through a media path of the print media system. In some implementations, the feed system 201 may further include a separator plate 207, wherein the print media 209 may be driven between the roller 212 and the separator plate 207 in the forward direction 215 through the media path. In further implementations, the print media 209, upon exiting between the roller 212 and the separator plate 207, may contact and be driven or pulled by a secondary or additional roller. In yet further implementations, the additional roller may be rotating at a faster rate than the roller 212 such that, upon pulling on the print media 209, the additionally roller causes the print media 209 to increase in speed.

Referring again to FIG. 2A, the lock 202 may be a component disposed adjacent to the roller 212 of the feed system 201. In some implementations, the lock 202 may be disposed along the longitudinal axis 205 of the roller 212. In further implementations, the lock 202 may be a cylindrical or partially cylindrical component and share the longitudinal axis 205 with the roller 212. In other words, the lock 202 and the roller 212 may be coaxial. In further implementations, the lock 202, the roller 212, as well as the drive shaft 216 may all be disposed concentrically or coaxially along longitudinal axis 205. In yet further implementations, the lock 202 may be movable, slidable, or otherwise translatable along the axis 205 such that the lock 202 may engage and also disengage with the roller 212 by translating along or parallel to axis 205. In some implementations, the lock 202 may be rotatably fixed about axis 205. In other words, although the lock 202 may be translatable along axis 205, the lock 202 may be prevented from rotating about the longitudinal axis 205.

In some situations, the lock 202 may include a coupling 204 to engage with a complementary coupling 214 of the roller 212. The coupling 204 and the complementary coupling 214 may be components such that, when they are operably engaged with one another, the coupling 204 and the complementary coupling 214 may mesh or mate such that they may not rotate relative to one another. Therefore, upon the lock 202 engaging with the roller 212 such that the coupling 204 engages with the complementary coupling 214, the lock 202 and the roller 212 may no longer be able to rotate along the longitudinal axis 205 relative to one another. In other words, the lock 202, upon operably engaging with the roller 212, may prevent the roller 212 from rotating about axis 205. The lock 202 may prevent the roller 212 from rotating in either the forward direction 211, or a reverse direction, or both.

The roller lock 200 may include a lead screw 206. The lead screw 206 may rotatably engage with the drive shaft 216 and the roller 212. The drive shaft 216 may switchably rotate the lead screw 206 between a forward direction and the reverse direction. In some implementations, the lead screw 206 may be a cylindrical or partially cylindrical component. In further implementations, the lead screw 206 may be disposed concentrically to the roller 212, the lock 202, and/or the drive shaft 216 along axis 205. Additionally, the lead screw 206 may operably engage with the lock 202. The lead screw 206 may engage with the lock 202 such that, upon the drive shaft 216 rotating the lead screw in a first direction, the lead screw 206 may force the lock 202 to translate along the longitudinal axis 205 in a first translation direction. Moreover, upon the drive shaft 216 rotating the lead screw in a second direction, opposite to the first direction, the lead screw 206 may force the lock 202 to translate along the longitudinal axis 205 in a second translation direction, which may be opposite from the first translation direction.

In some implementations, the lead screw 206 may include an advancer 208. The advancer 208 may operably engage with a complementary advancing feature 210 of the lock 202. In further implementations, the advancer 208 may translatably engage with the complementary advancing feature 210 such that, upon the advancer 208 engaging with and rotating relative to the complementary advancing feature 210, for example, about longitudinal axis 205, the advancer 208 may translate the complementary advancing feature 210, and thus the lock 202, along the longitudinal axis 205. In yet further implementations, the advancer 208 may be a thread, and the complementary advancing feature 210 may be a thread portion or a partial thread constructed such that it may threadably engage with the advancer 208. In some implementations, the axis of the thread of the advancer 208 may be disposed coaxially to the longitudinal axis 205. In further implementations, the thread of the advancer 208 is disposed coaxially to the drive shaft 216 such that upon a rotation of the drive shaft 216, the thread is to advance the thread portion along the longitudinal axis 205.

Figure 2C:
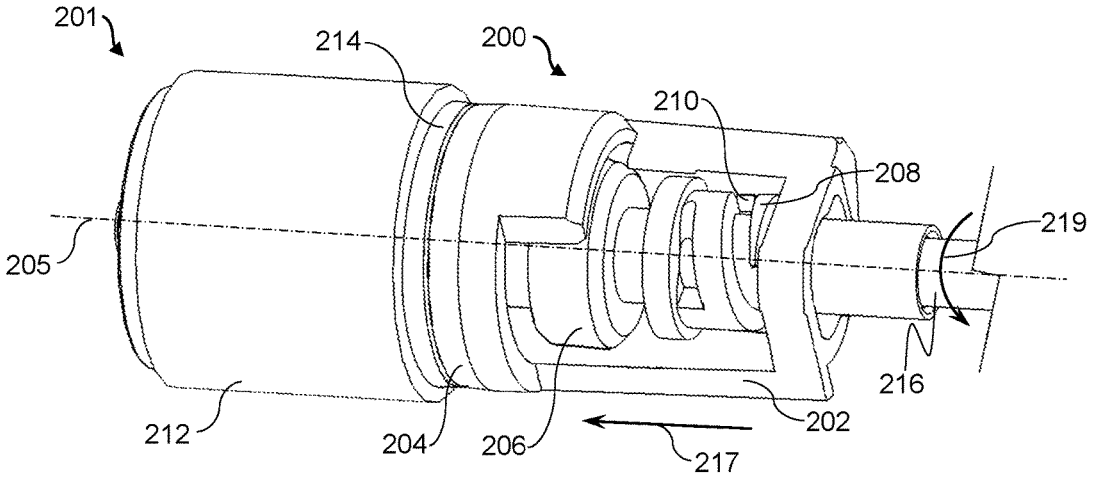
FIG. 2C is a perspective view of an example roller lock.

Referring now to FIG. 2C, a perspective view of an example roller lock 200 is illustrated, wherein the lock 202 is operably engaged with the roller 212. In some implementations, the advancer 208 may be engageable with the complementary advancing feature 210 such that, upon the drive shaft 216 rotating in a reverse direction 219, the lead screw 206 also rotates in the reverse direction 219 about axis 205, and the advancer 208 causes the complementary advancing feature 210, and thus the lock 202, to translate along the longitudinal axis 205 towards the roller 212 in a locking direction 217. The reverse direction, in some implementations, may be the opposite rotational direction as the forward direction. FIG. 2C illustrates the lock 202 as having been translated along axis 205 to the point of operable engagement with the roller 212. As described above, at this point the coupling 204 may be operably engaged with the complementary coupling 214 such that the lock 202 prevents the roller 212 from rotating any further in the forward direction 211 about longitudinal axis 205.

In further implementations, the advancer 208 may include the structure of a thread, and may have advanced the complementary advancing feature 210, having the structure of a partial thread, to the end of the thread structure on the lead screw 206. In such an implementation, the partial thread may contact and interfere with the end of the thread structure of the advancer 208 at the same time the lock 202 engages with the roller 212 and prevents the roller 212 from rotating in the forward direction 211 any further. At such a point, the interference between the partial thread and the end of the thread structure of the advancer 208 may cause the lead screw to stop rotating in the reverse direction. In some implementations, the drive shaft 216 may be driven by a motive component, such as an electric motor, for example, and may be engaged with a torque sensor that may determine the torque experienced by the drive shaft 216. Upon the interference between the partial thread and the end of the thread structure of the advancer 208 forcibly stopping the rotation of the lead screw 206, the drive shaft 216 may experience an increase in torque, which may be sensed by the torque sensor. Upon sensing such a spike or increase in torque, the sensor may signal the motive component to stop rotating or driving the drive shaft 216. In other implementations, the torque sensor may be engaged with the lead screw 206, or another component that enables the sensor to determine when the partial thread has contacted the end of the thread structure of the advancer 208. In yet further implementations, another sensor may determine when the lock 202 and the roller 212 have operably engaged, and may subsequently signal the motive component to stop driving the drive shaft 216.

Referring now to both FIGS. 2B and 2C, it should be noted that, in the position illustrated in FIG. 2C, the roller 212 may be prevented from rotating further in direction 211. Thus, print media 209 that is moved along direction 215 when the roller 212 is locked in place, as shown in FIG. 2C, may contact the roller 212 and encounter resistance as the roller 212 is prevented from rotating in direction 211. Thus, when the lock 202 is engaged with the roller 212 so that the roller 212 cannot rotate, a user or mechanism attempting to insert or move print media 209 beyond, over, or through the roller 212 may encounter resistance or tactile feedback. This resistance or tactile feedback may indicate to the user or mechanism that the print media 209 is in a correctly inserted or loaded position within the print media system. Further, upon the roller 212 being unlocked and freed to rotate again in the forward direction 211, the print media 209 may be oriented next to the roller 212 correctly such that the roller 212 can properly feed the print media 209 through the feed system 201.

After print media is loaded correctly into the print media system, the motive component may, again, drive the drive shaft 216 in the forward direction 213. The drive shaft 216 may, thus, drive the lead screw 206 in the forward direction. The advancer 208 of the lead screw 206 may, upon the lead screw 206 rotating in the forward direction, engage with the complementary advancing feature 210 of the lock 202 such that the lock 202 moves along or translates along the axis 205 away from the roller 212 in an unlocking direction opposite to direction 217. Upon the lock 202 translating along the unlocking direction, the coupling 204 may completely disengage from the complementary coupling 214 such that the roller 212 may be free to rotate in the forward direction 211 once again. The advancer 208 may continue to engage with the complementary advancing feature 210 so as to move the lock 202 along axis 205 until the complementary advancing feature 210 becomes disengaged with the advancer 208, and the lock 202 stops moving.

Figure 3A:
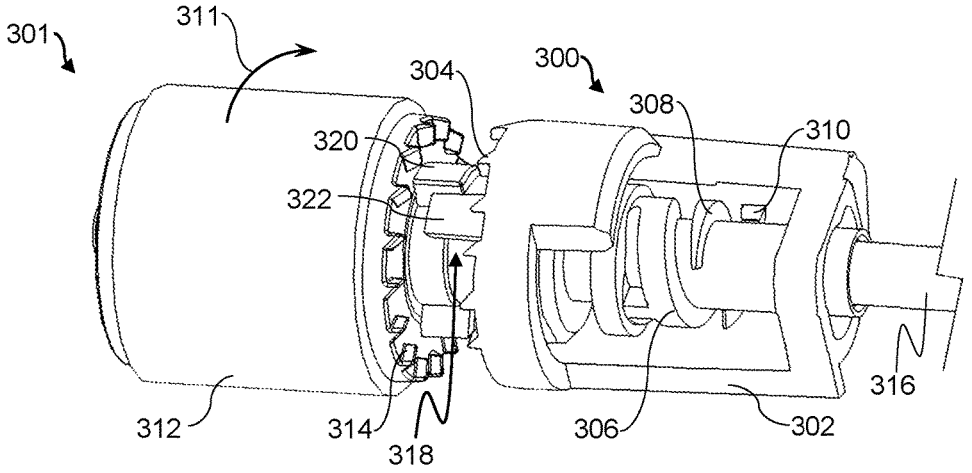
FIG. 3A is a perspective view of an example roller lock.

Referring now to FIG. 3A, a perspective view of an example roller lock 300 is illustrated. Example roller lock 300 may be similar to example roller lock 100 or 200. Further, the similarly named elements of example roller lock 300 may be similar in function and/or structure to the elements of example roller lock 100 or 200, as they are described above. Roller lock 300 may include a lock 302 with a coupling 304 to operably engage with a complementary coupling 314 of a roller 312 of a feed system 301. In some implementations, the coupling 304 and/or the complementary coupling 314 may include geometry capable of meshing or mating with each other, such as teeth, tabs, knurling, geometry similar in structure to a castle nut, or other geometry that may lock into a complementary geometry. In further implementations, the coupling 304 and/or the complementary coupling 314 may include a material that is conducive to locking through friction. Such a material may be a rubber or rubberized material, a rough material such as a sandpaper or a gravel-like material, or any other material having a sufficient coefficient of friction that the coupling 304 and the complementary coupling 314 are prevented from rotating relative to one another when mated together.

Figure 3B:
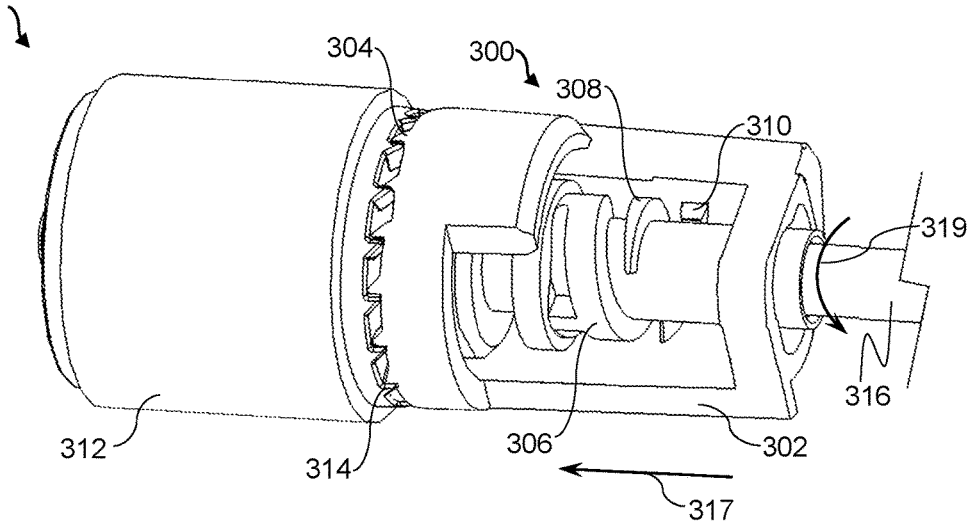
FIG. 3B is a perspective view of an example roller lock.

FIGS. 3A and 3B illustrate the coupling 304 and the complementary coupling 314 as each having a plurality of teeth to mesh with each other as one example geometry. The plurality of teeth of the coupling 304 may be to mesh with a complementary plurality of teeth of the complementary coupling 314 when the lock 302 is operably engaged with and mated to the roller 312, as illustrated in FIG. 3B. As described above, in some implementations, a drive shaft 316 of the feed system 301 may drive a lead screw 306 of the roller lock 300 in a reverse direction 319 such that an advancer 308 engages with a complementary advancing feature 310 of the lock 302. The engagement of the advancer 308 with the advancing feature 310 may cause the lock to translate towards the roller 312 in an example direction 317 such that the teeth of the coupling 304 and the teeth of the complementary coupling 314 operably engage. In the illustrated example, the plurality of teeth of the coupling 304 are engaged and meshed with the plurality of teeth of the complementary coupling 314 so as to prevent the roller 312 from rotating in a forward direction 311.

Still referring to FIGS. 3A-B, the feed system 301 may further include a clutch 318 operably disposed in between the drive shaft 316 and the roller 312. The clutch 318 may enable the drive shaft 316 to drive the roller 312 in the forward direction, while allowing the roller 312 to also be pulled further in the forward direction at a faster rate than the drive shaft 316 is rotating. In order to accomplish this, the clutch 318 may include a roller lug 320 disposed on the roller 312, as well as a drive lug 322, driven by the drive shaft 316. The drive shaft 316 may drive the drive lug 322 so that the drive lug pushes the roller lug 320, and thus the roller 312, in the forward direction 311. The roller lug 320 may not be fixed to the drive lug 322, in some implementations. Therefore, if the roller 312, and thus the roller lug 320, were to be pulled in the forward direction 311 at a faster rate of rotation than the drive shaft 316, and thus the drive lug 322, is rotating, then the roller lug 320 may pull away from the drive lug 322, and create a gap in between the two. In some implementations, the roller 312 may be pulled at a faster rate than the drive shaft 316 and drive lug 322 if print media being driven through the feed system 301 by the roller 312 engages with an additional roller that is rotating at a faster rate further down the media path from the roller 312. The additional roller may pull the print media, which may pull the roller 312, at a faster rate of rotation along the direction 311. After the print media has left contact with the roller 312, the roller 312 may stop rotating altogether, despite the drive shaft 316 continuing to rotate, due to the gap that has been created between the roller lug 320 and the drive lug 322. Once the gap is closed and the drive lug 322 makes contact with the roller lug 320, the roller 312 may continue to rotate in the forward direction 311 once again, and the roller 312 may then drive a subsequent piece of print media through the feed system 301. Therefore, the clutch 318 may intermittently drive the roller 312 in the forward direction 311 to create gaps in between each piece of print media fed by the roller 312 through the feed system.

In some implementations, the clutch 318 may further include a ratchet component operably disposed in between the lead screw 306 and the drive lug 322. In some implementations, the ratchet component may be a unitary component with the drive lug 322, or, in other implementations, the ratchet component may be a separate component assembled on to the drive lug 322. The ratchet component may be a transmission component that enables the lead screw 306 to rotate relative to the drive lug 322. The ratchet component may, in some implementations, allow the lead screw 306 to rotate in the reverse direction relative to the drive lug 322. The ratchet component may include an angled surface or multiple angled surfaces with which the lead screw 306 engages, creating geometry that enables ratcheting action, in certain situations. Upon the lead screw 306 being driven in the reverse direction, the lead screw 306 may contact the angled surfaces of the ratchet component and, through this contact, rotate the ratchet component, and thus, the drive lug 322, in the reverse direction until the drive lug 322 contacts another component in the feed system 301 or roller lock 300, preventing the drive lug 322 from rotating any further in the reverse direction. In some implementations, the drive lug 322 may contact another element or geometry of the roller 312, preventing the drive lug 322 from rotating further in the reverse direction. In such a situation, the lead screw 306 may continue to be driven in the reverse direction, despite the drive lug 322 not rotating, by action of the ratchet component.

The lock 302 may, in some implementations, be constructed such that, upon being translated in the example direction 317 and engaging with the roller 312, the lock 302 is able to fit around the clutch 318 and the roller lug 320 and the drive lug 322 thereof. Further, a drive stop, or, in other words, a gap, may be created between the drive lug 322 and the roller lug 320 when the drive shaft 316 and lead screw 306 stop rotating in the forward direction, and start to rotate in the reverse direction. The initial reverse rotation of the lead screw 306 may partially rotate the drive lug 322 in the reverse direction, away from the roller lug, creating a gap or drive stop. This drive stop may be created before the lock 302 fully engages the roller 312, in some implementations.

Upon the drive shaft 316 starting to rotate in the forward direction 311 once again, the lock 302 may begin to translate away from the roller 312, unlocking the roller and freeing it to again move in the forward direction 311 as well. The coupling 304 and the complementary coupling 314 may not fully disengage from each other and free the roller 312 until a certain amount of forward rotation has occurred in the drive shaft 316. The drive stop, or, in other words, the gap in between the roller lug 320 and the drive lug 322 may allow the lead screw 306, and thus the drive shaft 316, to partially rotate in the forward direction without rotating the roller 312, until the drive stop, or, in other words, the gap, closes and the drive lug 322 again contacts the roller lug 320. Additionally, in some implementations, an additional drive stop may be created by the ratchet component, wherein the lead screw 306 is able to rotate in the forward direction relative to the ratchet component before driving the ratchet component, and thus the drive lug 322, in the forward direction. This partial rotation of the lead screw 306 without driving the roller 312 may allow the lock to translate in an unlocking direction away from the roller 312 a sufficient amount to fully disengage the coupling 304 and the complementary coupling 314 before the roller 312 starts rotating again. In other words, the drive stop may allow the full unlocking of the roller 312 to occur before the forward rotation of the drive shaft 316 starts to drive the roller 312, avoiding a binding of the feed system 301.

Figure 4:
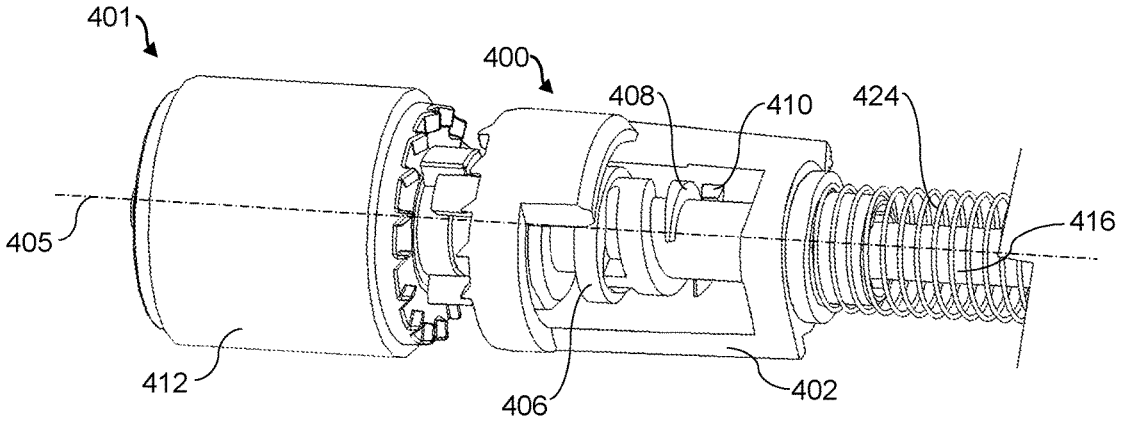
FIG. 4 is a perspective view of an example roller lock.

Referring now to FIG. 4, a perspective view of an example roller lock 400 is illustrated. Example roller lock 400 may be similar to example roller lock 100, 200, or 300. Further, the similarly named elements of example roller lock 400 may be similar in function and/or structure to the elements of example roller lock 100, 200, or 300, as they are described above. Example roller lock 400 may include a lock 402 to operably engage with a roller 412 of a feed system 401. Further, the example roller lock 400 may include a lead screw 406 having an advancer 408 to translatably engage with a complementary advancing feature 410 of the lock 402. In some implementations, the roller lock 400 may additionally include a bias member 424 to exert a force on the lock in a direction towards the roller 412. The bias member 424 may be a resilient component capable of elastic deformation, or, in other words, capable of returning to its original shape or geometry after being deformed. In some implementations, the bias member 424 may be a coil spring disposed along a longitudinal axis 405 of the roller 412, the lock 402, and/or the lead screw 406. In other implementations, the bias member may be another type of spring having a different disposition or geometry to exert a force on the lock 402 in the direction towards the roller 412.

In some implementations, the bias member 424 may exert the force on the lock 402 in the direction towards the lead screw 406 such that the lock 402 is always idling against an end of the lead screw 406 while a drive shaft 416 is driving the lead screw 406 in a forward direction. In other words, the complementary advancing feature 410 of the lock 402 is always in a position to engage with the advancer 408 as soon as the lead screw 406 starts to rotate in a reverse direction. In one example, the advancer may be a thread on the lead screw 406 and the thread may be structured to engage with the complementary advancing feature 410, which may be a partial thread or a portion of a thread. In such an example, the thread of the advancer 408, and the partial thread of the complementary advancing feature 410 may be right-handed threads. Therefore, as the lead screw 406 is driven in the forward direction, the bias member 424 may constantly push against the lock 402 so that the partial thread is abutted against the end of the thread of the advancer 408, yet the threads may not engage due to the rotation of the lead screw 406. Conversely, as the drive shaft 416 of the feed system 401 stops driving the lead screw 406 in the forward direction, and, instead, starts to drive the lead screw 406 in a reverse direction, the partial thread of the complementary advancing feature 410 may start to engage with and thread into the thread of the advancer 408. In such a situation, the complementary advancing feature 410 may start threading into the advancer 408 as soon as possible upon the lead screw 406 being driven in the reverse direction because of the constant force the bias member 424 exerts upon the lock against the lead screw 406.

What is claimed is:

1. A roller lock, comprising:

a lock to engage with a roller of a feed system, the lock including a coupling to operably engage with a complementary coupling of the roller; and a leadscrew to engage with the lock, the leadscrew including an advancer to engage with the lock such that the advancer translates the lock along a longitudinal axis of the roller so that the lock may engage and disengage with the roller to intermittently prevent the roller from rotating in a forward direction.

2. The roller lock of claim 1, wherein the lock further comprises a complementary advancing feature to engage with the advancer of the leadscrew, such that, upon a drive shaft of the feed system rotating the leadscrew in a reverse direction, the advancer translates the lock along the longitudinal axis of the roller to engage with the roller.

3. The roller lock of claim 2, wherein, upon the drive shaft rotating the leadscrew in a forward direction, the advancer translates the lock along the longitudinal axis of the roller to disengage with the roller.

4. The roller lock of claim 3, wherein the advancer comprises a thread, and the complementary advancing feature comprises a thread portion to threadably engage with the thread of the advancer.

5. The roller lock of claim 4, wherein the thread of the advancer is disposed coaxially to the drive shaft, such that upon a rotation of the drive shaft, the thread is to advance the thread portion along the longitudinal axis.

6. The roller lock of claim 1, wherein the coupling includes a plurality of teeth to engage with a plurality of complementary teeth disposed on the complementary coupling of the roller so as to prevent the roller from rolling when the teeth are engaged.

7. The roller lock of claim 1, further comprising a bias member to bias the lock in a direction towards the leadscrew.

8. The roller lock of claim 7, further comprising a bias member to bias the lock in a direction towards the leadscrew.

9. A roller lock, comprising:

a lock to engage with a roller of a feed system, the lock including a plurality of teeth to engage with a plurality of complementary teeth on the roller such that, when the teeth are engaged, the roller is unable to rotate in a forward direction; and a leadscrew rotatably engaged with a drive shaft of the roller, the drive shaft to switchably rotate the leadscrew in the forward direction and a reverse direction, and the leadscrew including an advancer to engage with a complementary advancing feature on the lock such that the leadscrew advances the lock along a longitudinal axis of the roller upon the leadscrew being rotated by the drive shaft.

10. The roller lock of claim 9, wherein the advancer is a thread and the complementary advancing feature is a thread portion to threadably engage with the thread of the advancer.

11. The roller lock of claim 10, wherein, upon the drive shaft rotating the leadscrew in a reverse direction, the leadscrew is to advance the lock towards the roller so that the plurality of teeth of the lock engage with the plurality of complementary teeth on the roller.

12. The roller lock of claim 11, wherein, upon the drive shaft rotating the leadscrew in a forward direction, the leadscrew is to advance the lock away from the roller so that the plurality of teeth of the lock disengage with the plurality of complementary teeth on the roller.

13. A feed system, comprising:

a roller to rotate in a forward direction to advance print media through the feed system;

a drive shaft to drive a clutch in the forward direction, the clutch to intermittently drive the roller in the forward direction upon being driven by the drive shaft; and a roller lock, comprising:

a lock to removably engage with the roller upon the drive shaft rotating in a reverse direction, such that the roller is unable to rotate in the forward direction when engaged with the lock; and a leadscrew rotatably engaged with the drive shaft and comprising an advancer to advance the lock along a longitudinal axis of the roller to engage and disengage the lock with the roller.

14. The feed system of claim 13, wherein the roller lock further comprises a drive stop to prevent the roller from being driven in the forward direction by the drive shaft until the lock has completely disengaged from the roller.

15. The feed system of claim 14, wherein the lock comprises a plurality of teeth to engage with a plurality of complementary teeth on the roller to prevent the roller from rotating in the forward direction.

* * * * *